US005850583A

United States Patent [19]

Song et al.

[11] Patent Number: 5,850,583

[45] Date of Patent: Dec. 15, 1998

[54] TECHNIQUES FOR GENERATING STATUS MESSAGES IN IMAGE FORMING APPARATUS

[75] Inventors: Won-Hyun Song; Bum-Chae Chung; Seung-Dae Kim, all of Suwon, Rep. of Korea

[73] Assignee: SamSung Electronics Co., Ltd., Suwon, Rep. of Korea

[21] Appl. No.: 881,565

[22] Filed: Jun. 24, 1997

[30] Foreign Application Priority Data

Jun. 24, 1996 [KR] Rep. of Korea ..... 1996-23337

[51] Int. Cl.[6] ..... G03G 15/60; G03G 21/16

[52] U.S. Cl. ..... 399/24; 399/81

[58] Field of Search ..... 399/21, 25, 26, 399/27, 10, 81, 15

[56] References Cited

U.S. PATENT DOCUMENTS

| | | | |
|---|---|---|---|
| 4,583,834 | 4/1986 | Seko et al. . | |
| 4,851,875 | 7/1989 | Tanimoto . | |
| 4,870,459 | 9/1989 | Ito et al. . | |
| 4,922,294 | 5/1990 | Nakagami et al. . | |
| 5,021,828 | 6/1991 | Yamaguchi et al. . | |
| 5,200,779 | 4/1993 | Nawata . | |
| 5,208,626 | 5/1993 | Tanimoto et al. | 399/111 |
| 5,216,464 | 6/1993 | Kotani et al. . | |
| 5,283,613 | 2/1994 | Midgley, Sr. . | |
| 5,305,199 | 4/1994 | LoBiondo et al. . | |
| 5,335,048 | 8/1994 | Takano et al. . | |
| 5,383,004 | 1/1995 | Miller et al. . | |
| 5,517,282 | 5/1996 | Yamashita et al. . | |
| 5,717,974 | 2/1998 | Park | 399/24 |

*Primary Examiner*—Joan H. Pendegrass
*Attorney, Agent, or Firm*—Robert E. Bushnell, Esq.

[57] ABSTRACT

An image forming apparatus includes detachable expendables such as a photosensitive drum, a toner cartridge, an ozone filter, etc. The image forming apparatus counts a number of papers being printed after replacing the expendable and stores a counting value as an amount of use in a nonvolatile memory, and prints out a status message including the amount of use, periodically or whenever the image forming apparatus is turned on. Further, the status message includes a predetermined test pattern for testing the printing status of the printer. In the light of the status message, the user may predict in advance the proper replacing time and cope with degradation of the images by checking the printing status from the test pattern at any time.

34 Claims, 7 Drawing Sheets

TECHNIQUES FOR GENERATING STATUS MESSAGES IN IMAGE FORMING APPARATUS

CLAIM OF PRIORITY

This application makes reference to, incorporates the same herein, and claims all benefits accruing under 35 U.S.C. §119 from an application for METHOD FOR GENERATING STATUS MESSAGE IN IMAGE FORMING APPARATUS earlier filed in the Korean Industrial Property Office on 24 Jun. 1996 and there duly assigned Ser. No. 23337/1996, a copy of which application is annexed hereto.

BACKGROUND OF THE INVENTION

1. Field of the Invention

The present invention relates to an image forming apparatus with detachable expendables, and more particularly a technique for generating status messages concerning service lives of the expendables.

2. Description of the Related Art

It is a recent tendency that an image forming apparatus such as an electrophotographic printer, a copying machine, a facsimile machine, etc. includes various expendables each being mounted on associated casings. For example, the electrophotographic printer includes various expendables such as a photosensitive drum, atoner cartridge, an ozone filter, etc. Such expendables should be replaced when the service lives thereof have expired. Therefore, the image forming apparatus generally includes a function for managing the service lives of the expendables.

In general, the image forming apparatus continuously counts the number of papers that have been used up to now after a replacement of the expendables, in order to check from the counting results whether or not the service lives of the respective expendables have expired. When the service lives have expired, messages for requesting a replacement of the expendables are displayed on a display unit in the image forming apparatus. In this case, the counting results are commonly stored in an EEPROM (Electrically Erasable and Programmable Read Only Memory), so that the counting data may not be lost even when the image forming apparatus is turned off. The counting data may be cleared automatically or manually when the associated expendables are replaced. However, in general, the display unit in the image forming apparatus has a limited display area, so that the messages for requesting the replacement of the expendables must be displayed with symbols or short abbreviations. Therefore, it may be difficult for the user to quickly and clearly understand the meaning of the displayed messages, thereby sometimes missing a proper replacing time of the expendables. If the expendables are not replaced at a proper replacing time, the image will be degraded and, what is worse, the apparatus may become inoperative.

A prior art apparatus proposed for solving the foregoing problems is well disclosed in U.S. Pat. No. 5,208,626 entitled with "Image Forming Apparatus having a Detachably Mounted Processing Unit", issued to Tanimoto, et. al. on May 4, 1993. The prior art apparatus prints out maintenance messages information on a recording medium, if an amount of use for a processing unit which is an expendable reaches a predetermined value. The maintenance message includes the replacing method as well as the replacement message.

However, the prior art apparatus generates the maintenance message only when the service life of the processing unit has expired, so that the user may not predict the proper replacing time in advance. Therefore, the user may not replace the processing unit in due time, in the case where there are not enough processing units in stock. Further, the service lives of the expendables are practically varied according to the status of the expendables and the image forming apparatus. Therefore, in some cases, the image may be degraded due to the service life expiration of the expendables, prior to generation of the maintenance messages.

The patent to Nakagami et al, U.S. Pat. No. 4,922,294, entitled Image Forming Apparatus, discloses an image forming apparatus in which a status message is printed at a point in time prior to the time at which an expendable is to be replaced. However, the printed message does not include the amount of use as in the present invention.

The following patents each disclose image forming apparatus which keep track of the amount of use of expendables, some of which even indicating the amount of use on a display screen. However, none of these references teaches or suggests printing out a status message including the amount of use whenever the image forming apparatus is turned on or at a predetermined time period as in the present invention: U.S. Pat. No. 5,283,613 to Midgley Sr., entitled Monitoring System With Dual Memory For Eletrophotographic Printing Machines Using Replaceable Cartridges, U.S. Pat. No. 5,200,779 to Nawata, entitled Image Forming Apparatus With Maintenance Procedure, U.S. Pat. No. 5,216,464 to Kotani et al, entitled Image Forming Apparatus Having Replaceable Element Which Is Replaced Based On Frequency Of Use, U.S. Pat. No. 5,305,199 to LoBiondo et al., entitled Consumable Supplies Monitoring/Ordering System For Reprographic Equipment, U.S. Pat. No. 5,335,048 to Takano et al., entitled Efficient Control System Of Image Forming Apparatus, U.S. Pat. No. 5,383,004 to Miller et al., entitled Normalizing Sheet Count To Predict Hardware Replacement Intervals, U.S. Pat. No. 4,851,875 to Tanimoto, entitled Identification And Monitoring Of Image Forming Process Units, U.S. Pat. No. 5,021,828 to Yamaguchi et al., entitled Copying Apparatus Having A Consumable Part, U.S. Pat. No. 5,101,233 to Ito et al., entitled Electrophotographic Recording Apparatus Indicating A Wear Rate For Consumable Parts, U.S. Pat. No. 5,517,282 to Yamashita et al., entitled Management System Of Image Forming Apparatuses, U.S. Pat. No. 4,583,834 to Seko et al., entitled Copying Apparatus, and U.S. Pat. No. 4,870,459 to Ito et al., entitled Copying Machine.

SUMMARY OF THE INVENTION

It is therefore an object of the present invention to provide a method of generating a status message, capable of predicting in advance a proper replacing time of expendables in an image forming apparatus.

It is another object of the present invention to provide a method for informing a user of a printing status of an image forming apparatus.

According to an aspect of the present invention, an image forming apparatus including at least one detachable expendable, counts a number of papers being printed after replacing the expendable and stores a counting value as an amount of use in a nonvolatile memory, and prints out the status message including the amount of use, periodically or whenever the image forming apparatus is turned on. Further, the status message includes a predetermined test pattern for testing the printing status of the printer.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
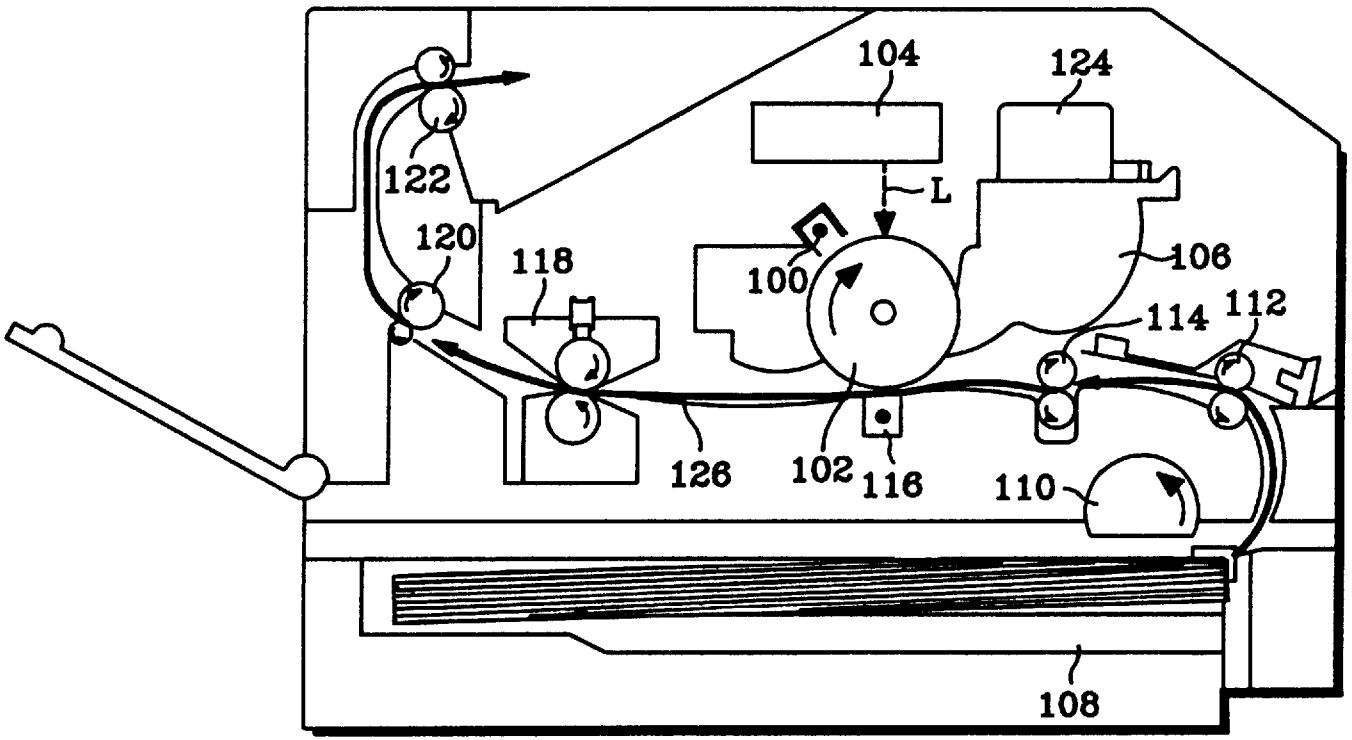
FIG. 1 is a diagram showing a mechanism of a common laser printer employed with the present invention.

A preferred embodiment of the present invention will be described in detail hereinbelow with reference to the attached drawings, in which the like reference numerals represent the like elements. Further, it should be clearly understood by those skilled in the art that many specifics such as the detailed circuit elements are shown only by way of an example to bring a better understanding of the present invention and tile present invention may be embodied without those specifics. Moreover, it should be noted that detailed descriptions of the related prior art may have been intentionally omitted if it was believed to be unnecessary in describing the concepts of the present invention. Furthermore, for the convenience of explanation, the present invention will be described with reference to a laser printer which is one of the typical image forming apparatus.

Referring first to FIG. 1, there is illustrated a cross-sectional view of a common laser printer. As illustrated, a charging device 100 uniformly charges a surface of a photosensitive drum 102. A laser scanner unit 104 generates a laser beam according to image data and exposes the photosensitive drum 102 to the laser beam so as to form an electrostatic latent image on the photosensitive drum 102. A developing device 106 provides a toner to the electrostatic latent image on the photosensitive drum In 102. The toner is contained in atoner cartridge 124. A pickup roller 110 picks up the paper stacked in a paper feeding cassette 108 and feeds the paper to a register roller 114 via a transfer roller 112. The register roller 114 rearranges a front end of the feeding paper and passes it through a developer 116. The developer 116 moves the toner attached on the electrostatic latent image to the paper. A fixing device 118 fly fixes the toner transcribed on the paper with a predetermined heat and pressure. Take-out rollers 120 and 122 take the paper out of the printer. An ozone filter (not shown) prevents ozone generated when charging the photosensitive drum 102 from being discharged from the printer. As described in the foregoing, the photosensitive drum 102, the toner cartridge 124, and the ozone filter are detachable from the laser printer.

Figure 2:
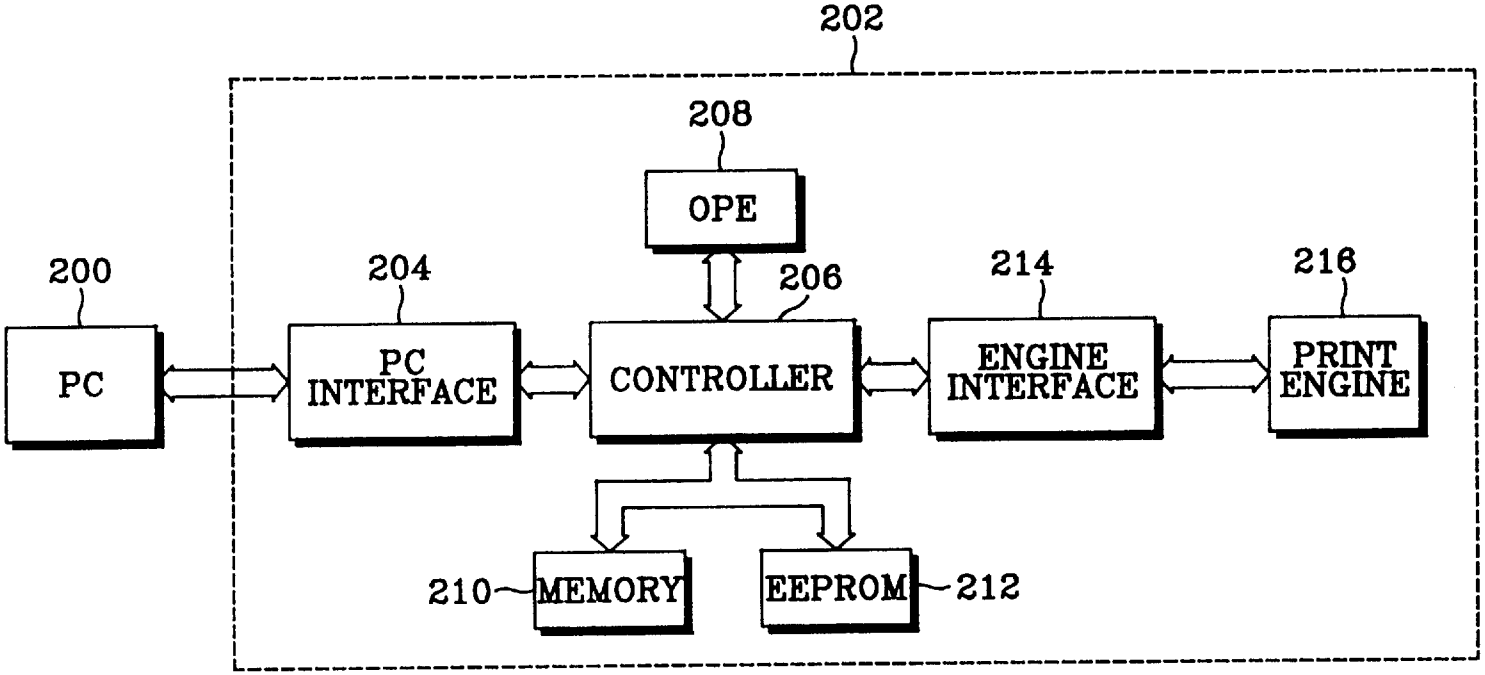
FIG. 2 is a block diagram of a common laser printer for generating a status message according to the present invention.

Referring to FIG. 2, there is illustrated a system block diagram of a laser printer 202 having the mechanism as shown in FIG. 1. The laser printer 202, connected to a personal computer (PC) 200, includes a PC interface 204, a controller 206, an operating panel 208, a memory 210, an electrically erasable programmable read only memory EEPROM 212, an engine interface 214, and a print engine 216. The PC interface 204 interfaces the personal computer 200 and the controller 206. The controller 206 communicates with the personal computer 200 according to a software program stored in a ROM (Read Only Memory) in the memory 210, and controls the print engine 216 according to various commands received from the personal computer 200 and the operating panel 208. Furthermore, the controller 206 provides the print engine 216 with printing data received from the personal computer 200. The operating panel 208 includes a plurality of input keys for generating various commands and a display unit for displaying various operating information of the printer. The memory 210 includes the ROM for storing the software program for the controller 206 and various reference data, and a RAM (Random Access Memory) for temporarily storing processing data from the controller 206. The EEPROM 212 stores data pertinent to the amount of use for the expendables according to the present invention. The engine interface 214 interfaces the controller 206 and the print engine 216. The print engine 216, including the mechanism as shown in FIG. 1, prints out the image data received from the controller 206 electrophotographically.

The printer according to the present invention prints out the status message including the amount of use for the detachable expendables such as the photosensitive drum 102, the toner cartridge 124, and the ozone filter, periodically or whenever the printer is turned on. The status message may also include a predetermined test pattern for testing the printing status of the printer. Therefore, the user may predict in advance the replacing time of the expendables and prepare the corresponding expendables in advance, so as to replace the expendables in due time. Furthermore, the user may check the printing status from the test pattern at any time, and cope with degradation of the images.

Figure 3:
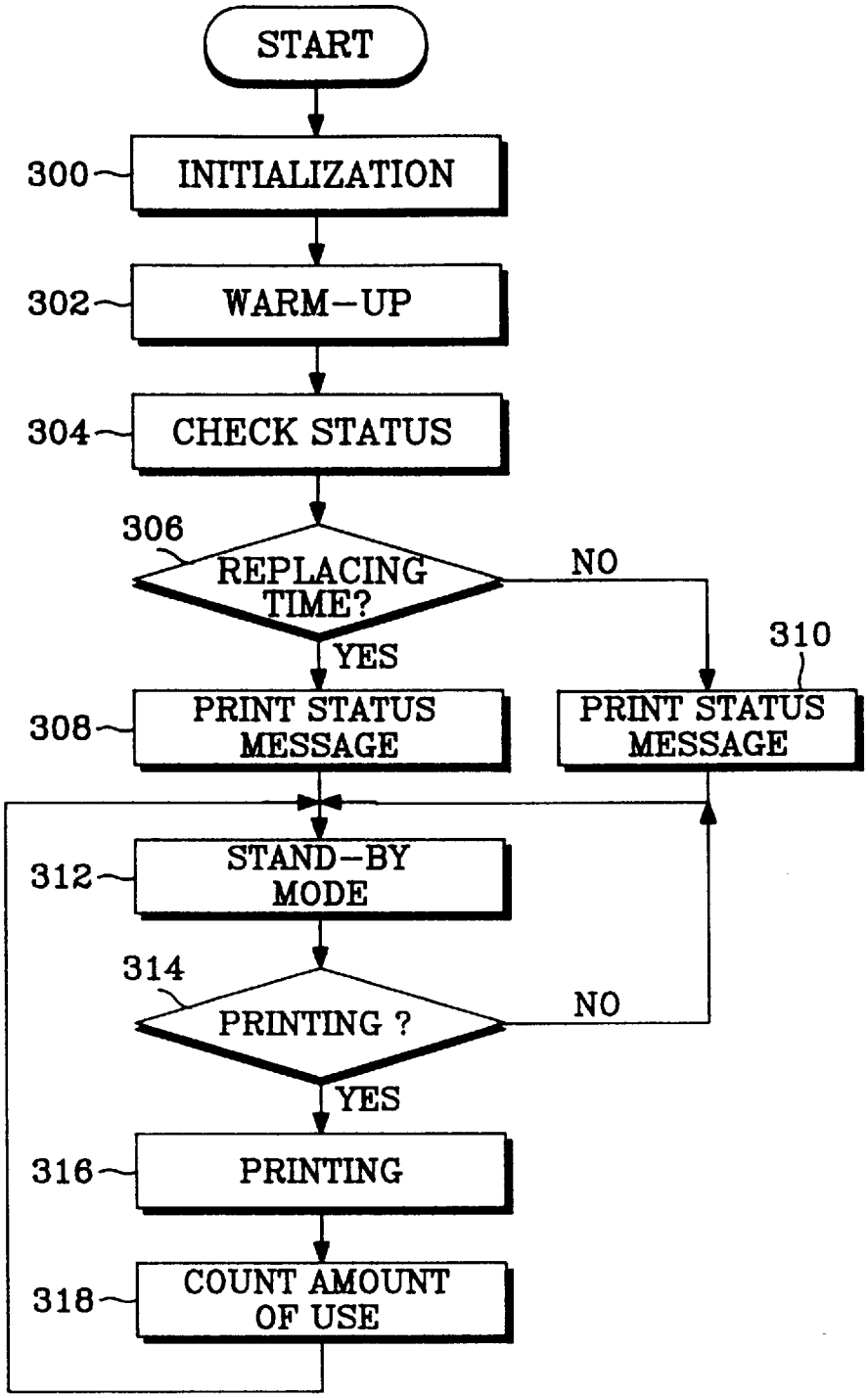
FIG. 3 is a flowchart illustrating the generating of a status message according to an embodiment of the present invention.

Referring to FIG. 3, there is shown a flowchart illustrating the generating of the status message according to the present invention. Whenever printing each paper, the number of printing papers is counted up so as to store the counting value, as the amount of use, in the EEPROM 212. In light of the counting results, the status messages are printed on the paper. Such a process flow is controlled by the controller 206 based on a software program stored in the ROM in the memory 210.

Figure 4A:
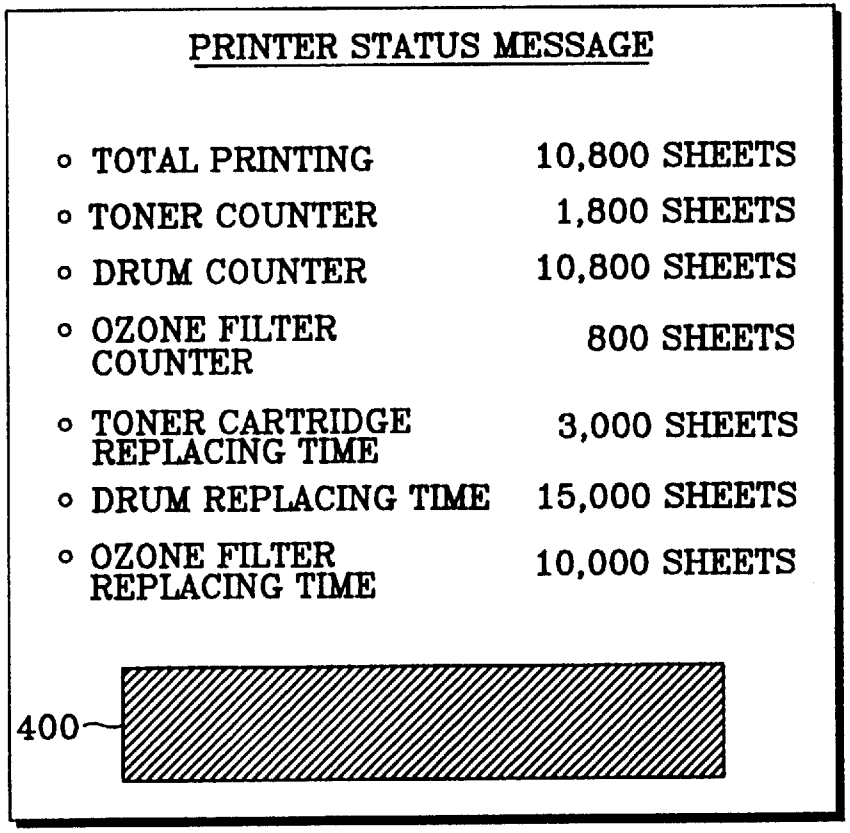
FIGS. 4A and 4B are exemplary diagrams showing status messages according to the present invention.
Figure 4B:
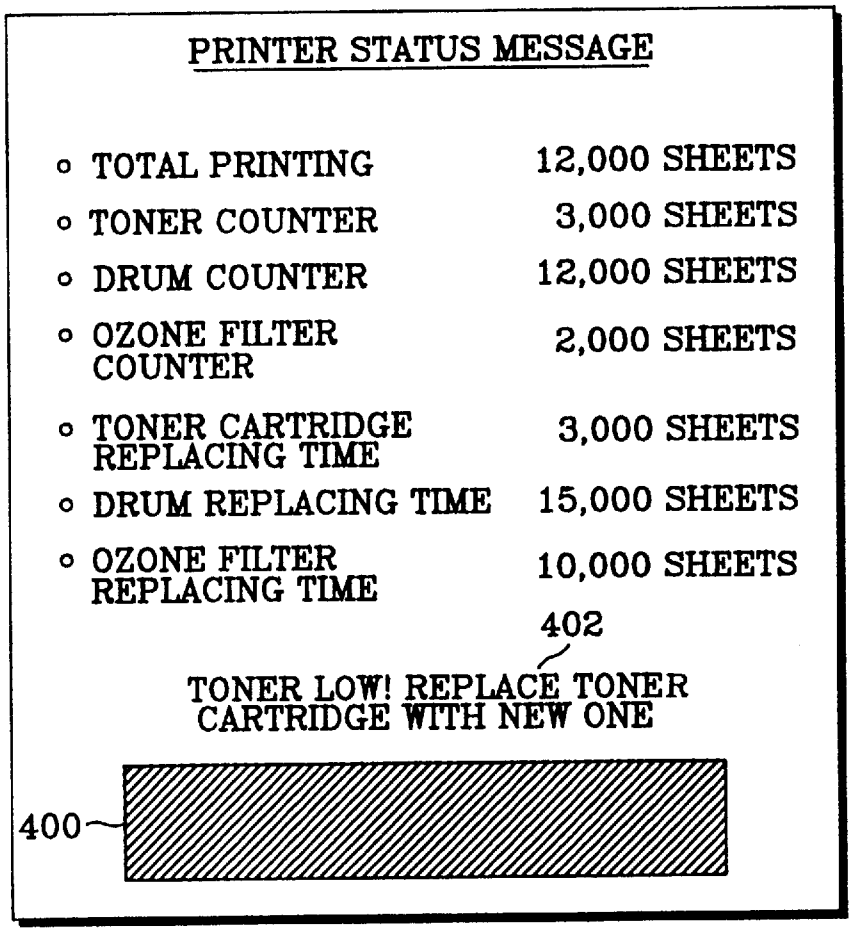

Now, referring to FIGS. 1 through 4B, operation of the printer according to the present invention will be described in detail hereinbelow. For example, as shown in FIGS. 4A and 4B, the status message has a format including the amount of use for the expendables and the test pattern 400. Such format and associated information are previously stored into the ROM in the memory 210. In FIGS. 4A and 4B, the message "Total Printing" represents the total number of papers that have been printed by the printer from beginning up to the present. The messages "Toner Counter", "Drum Counter", and "Ozone Filter Counter" represent the numbers of papers that have been printed after the latest replacement of the toner cartridge 124, the photosensitive drum 102, and the ozone filter, respectively. The messages "Toner Cartridge Replacing Time", "drum Replacing time", and "Ozone Filter Replacing time" represent the service lives of the toner cartridge 124, the photosensitive drum 102, and the ozone filter, respectively. Further, a reference numeral 402 represents replacement request information. FIG. 4A represents the printer status message generated when the service lives of the expendables have not expired, while FIG. 4B represents the printer status message generated when the service life of the toner cartridge 124 has expired. The replacement request information 402 of FIG. 4B shows an example that the service life of the toner cartridge 124 has expired. The test pattern 400 is a normal test pattern for checking the printing status of the printer.

In operation, when the printer is turned on, the controller 206 performs normal initialization and warm-up operations at steps 300 and 302, respectively. Thereafter, the controller 206 checks the status (i.e., the amount of use) of the expendables at step 304, by referring to the toner counter, drum counter, and the ozone filter counter, respectively. The counting values of the respective counters are stored in the EEPROM 212. Then, the controller 206 compares the amounts of use for the respective expendables with predetermined warning values at step 306, so as to check whether or not any of the service lives have expired. The warning values are preferably set to be lower than the actual replacing time values for the respective expendables, so as to generate the status messages as shown in FIG. 4B when the amounts of use almost reach the corresponding replacing times. If any one of the expendables has the amount of use which is equal to or higher than the corresponding warning value, the controller 206 controls the print engine 216 to print out the status message including the replacement request information 402 as shown in FIG. 4B, at step 308. On the contrary, if all the expendables have amounts of use which are lower than the corresponding warning values, the controller 206 controls the print engine 216 to print out the status message not including the replacement request information 402 as shown in FIG. 4A, at step 310.

In this manner, whenever the printer is turned on, the printer status message including the amounts of use and the test pattern is generated. Therefore, the user may predict in advance the proper replacing time and cope with degradation of the images by checking the printing status from the test pattern at any time.

At steps 312 through 318, the controller 206 performs a normal stand-by mode, and controls the print engine 216 to print the printing image data if received from the personal Computer 200. Whenever printing each paper, the controller 206 updates the counting values of the toner, drum and ozone filter counters which are stored in the EEPROM 212. As usual, the amounts of use for the respective expendables may be automatically cleared or manually cleared by the key operations, when the expendables are replaced. Therefore, the number of printed paper sheets is newly counted after replacing the respective expendables, and stored as the amount of use in the EEPROM 212.

Figure 5:
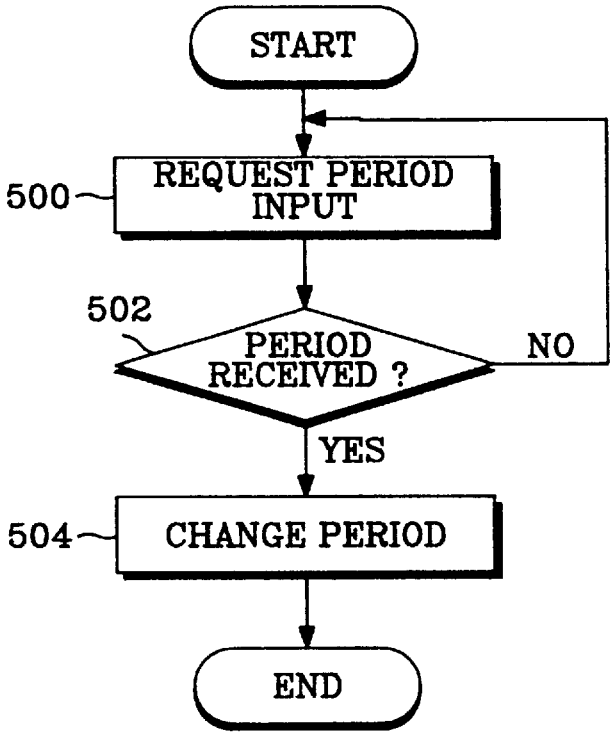
FIG. 5 is a flowchart illustrating the setting of a message generation period according to another embodiment of the present invention.
Figure 6:
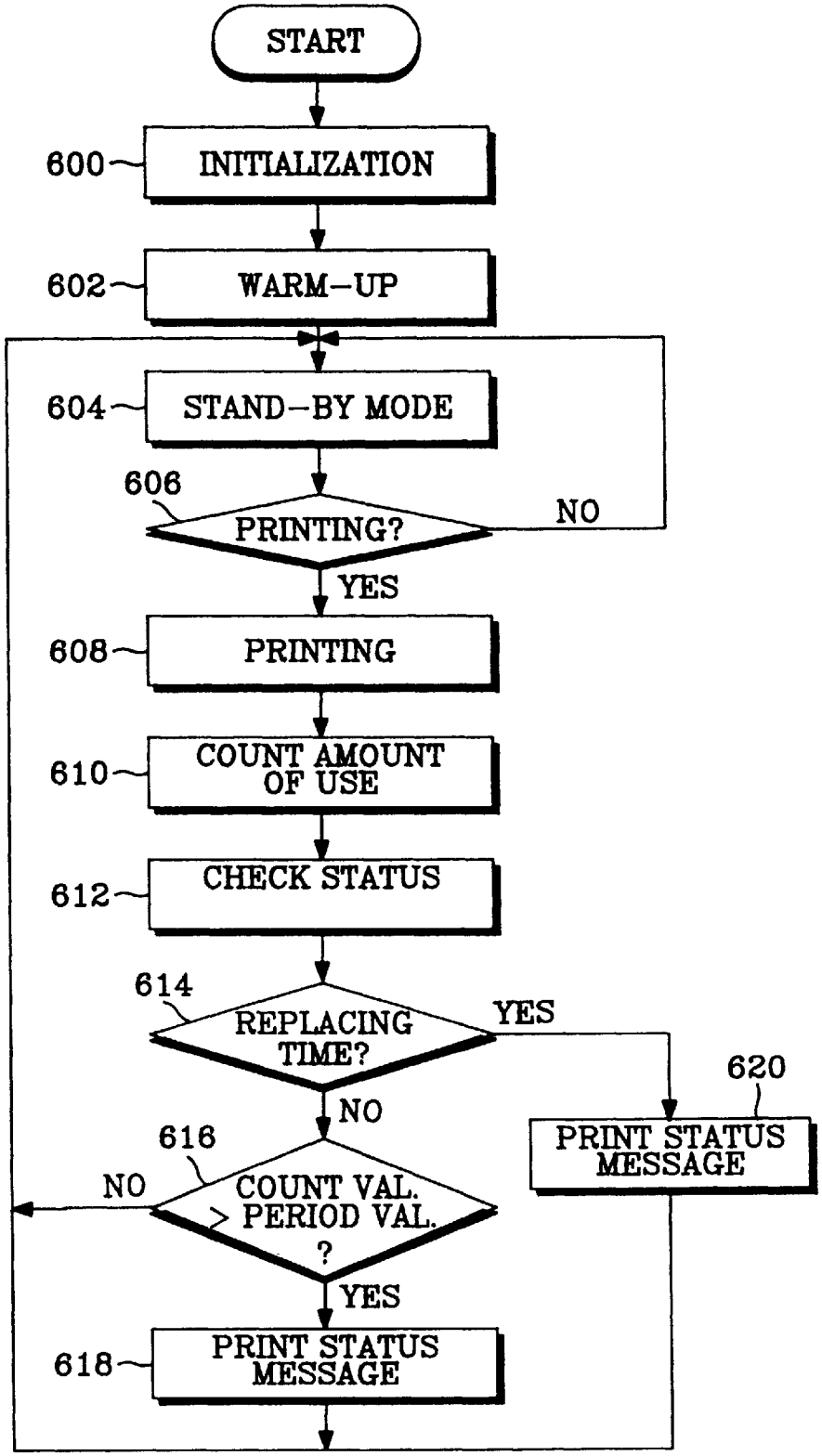
FIG. 6 is a flowchart illustrating generating of a status message according to another embodiment of the present invention.

Meanwhile, the printer status message may also be printed out periodically. Namely, FIG. 5 shows a flowchart illustrating the setting of a message generation period according to another embodiment of the present invention, and FIG. 6 shows a flowchart illustrating the generating of the status message periodically based on the foregoing message generation period. Such a process flow is controlled by the controller 206 based on a software program stored into the ROM in the memory 210.

Now, referring to FIGS. 1, 2, and 4A to 6, if the user operates the operating panel 208 during the stand-by mode of the printer to generate a key input for changing the message generation period, the controller 206 displays a message for requesting a new message generation period input on the display unit of the operating panel 208, at steps 500 and 502. In order to generate the key input for changing the message generation period, the user may depress a separate key in the operating panel 208, or utilize a normal menu selection function. Upon receiving the message generation period input (for example, to generate the status message every 200 sheets), the controller 206 stores the message generation period in the EEPROM 212 to change the message generation period to the desired period. It may also be possible that the manufacturer determines the message generation period arbitrarily and stores it into the ROM in the memory 210.

After a while, when the printer is turned on, the controller 206 performs normal initialization and warm-up operations at steps 600 and 602, respectively. Thereafter, the controller 206 performs a normal stand-by mode at a step 604. During the stand-by mode, if the printing data is received from the personal computer 200, the controller 206 provides the print engine 216 with the printing image data so as to perform the printing operation, at steps 606 and 608. As described hereinabove, whenever printing each paper, the controller 206 updates, at step 610, the counting values of the toner, drum and ozone filter counters which are stored in the EEPROM 212.

Thereafter, the controller 206 checks the status (i.e., the amount of use) of the expendables at step 612, by referring to the toner counter, drum counter, and the ozone filter counter, respectively. Then, the controller 206 compares the amounts of use for the respective expendables with the predetermined warning values at step 614, so as to check whether or not any of the service lives have expired. If any one of the expendables has an amount of use which is higher than the corresponding warning value, the controller 206 controls, at step 620, the print engine 216 to print out the status message including the replacement request information 402 as shown in FIG. 4B. On the contrary, if all the expendables have amounts of use which are lower than the corresponding warning values, the controller 206 checks whether or not the counting value has reached the message generation period (i.e., 200 sheets), at step 616. If the counting value has reached the message generation period, the controller 206 controls the print engine 216 to print out the status message not including the replacement request information 402 as shown in FIG. 4A, at step 618. Otherwise, if the counting value has not reached the message generation period, the controller 206 returns to the step 604.

In this way, the printer periodically generates the printer status message including the amounts of use and the test pattern. Therefore, the user may predict well in advance the proper replacing time and cope with degradation of the images by checking the printing status from the test pattern at any time.

Although a preferred embodiment of the present invention has been described in detail hereinabove, It should be clearly understood that many variations and/or modifications of the basic inventive concepts herein taught which may appear to those skilled in the art will still fall within the spirit and scope of the present invention as defined in the appended claims. For example, although the present invention has been described with reference to the laser printer by way of example, the same may be employed in an ink jet printer, a facsimile machine, or an LED printer including detachable expendables. Further, if necessary, the two different embodiments described above may be merged together, and the kinds of the expendables and the associated messages may also be freely changed within the spirit and scope of the present invention.

What is claimed is:

1. A method of generating a status message in an image forming apparatus including at least one detachable expendable, comprising the steps of:

counting a number of papers being printed after the at least one expendable has been replaced, and storing a counting value as an amount of use in a nonvolatile memory; and printing out the status message including the amount of use, whenever the image forming apparatus is turned on.

2. A method of generating a status message according to claim 1, said amount of use being set to zero whenever the at least one expendable is replaced.

3. A method of generating a status message according to claim 2, said status message comprising a predetermined replacing time value of the at least one expendable.

4. A method of generating a status message according to claim 3, further comprising the steps of: comparing said amount of use with a predetermined warning value which is set to be lower than said replacing time value, and adding replacement request information to said status message if the amount of use is greater than the warning value.

5. A method of generating a status message according to claim 1, said status message comprising a predetermined test pattern for testing a printing status of the image forming apparatus.

6. A method of generating a status message in an image forming apparatus including at least one expendable, comprising the steps of:

counting a number of papers being printed after the at least one expendable has been replaced, and storing a counting value as an amount of use in a nonvolatile memory; and printing out the status message including the amount of use at a predetermined time period;

further comprising the steps of: comparing said amount of use with a predetermined warning value which is set to be lower than a predetermined replacing time value of the at least one expandable, and adding replacement request information to said status message if the amount of use is greater than the warning value.

7. A method of generating a status message according to claim 6, said amount of use being set to zero whenever the at least one expendable is replaced.

8. A method of generating a status message according to claim 7, said predetermined time period either being fixed at a constant value, or set by a user to a predetermined number of papers.

9. A method of generating a status message according to claim 6, said predetermined time period either being fixed at a constant value, or set by a user to a predetermined number of papers.

10. A method of generating a status message in an image forming apparatus including at least one expendable, comprising the steps of:

counting a number of papers being printed after the at least one expendable has been replaced, and storing a counting value as an amount of use in a nonvolatile memory; and printing out the status message including the amount of use at a predetermined time period;

said status message comprising a predetermined test pattern for testing a printing status of the image forming apparatus.

11. A method of generating a status message according to claim 10, said amount of use being set to zero whenever the at least one expendable is replaced.

12. A method of generating a status message according to claim 11, said predetermined time period either being fixed at a constant value, or set by a user to a predetermined number of papers.

13. A method of generating a status message according to claim 12 said status message comprising a predetermined replacing time value of the at least one expendable.

14. A method of generating a status message according to claim 13, further comprising the steps of: comparing said amount of use with a predetermined warning value which is set to be lower than said replacing time value, and adding replacement request information to said status message if the amount of use is greater than the warning value.

15. A method of generating a status message according to claim 10, said predetermined time period either being fixed at a constant value, or set by a user to a predetermined number of papers.

16. A method of generating a status message according to claim 15, said status message comprising a predetermined replacing time value of the at least one expendable.

17. A method of generating a status message according to claim 16, further comprising the steps of: comparing said amount of use with a predetermined warning value which is set to be lower than said replacing time value, and adding replacement request information to said status message if the amount of use is greater than the warning value.

18. An apparatus for generating a status message in an image forming apparatus including at least one detachable expendable, comprising:

a counter for counting a number of papers being printed after the at least one expendable has been replaced, and a nonvolatile memory for storing a counting value as an amount of use; and a means for causing the printing out of the status message including the amount of use, whenever the image forming apparatus is turned on.

19. An apparatus for generating a status message according to claim 18, further comprising a means for setting said amount of use to zero whenever the at least one expendable is replaced.

20. An apparatus for generating a status message according to claim 19, said status message comprising a predetermined replacing time value of the at least one expendable.

21. An apparatus for generating a status message according to claim 20, further comprising a comparator for comparing said amount of use with a predetermined warning value which is set to be lower than said replacing time value, and a means for adding replacement request information to said status message if the amount of use is determined to be greater than the warning value.

22. An apparatus for generating a status message according to claim 18, said status message comprising a predetermined test pattern for testing a printing status of the image forming apparatus.

23. An apparatus for generating a status message in an image forming apparatus including at least one expendable, comprising:

a counter for counting a number of papers being printed after the at least one expendable has been replaced, and a nonvolatile memory for storing a counting value as an amount of use; and a means for causing the printing out of the status message including the amount of use at a predetermined time period;

further comprising: a comparator for comparing said amount of use with a predetermined warning value which is set to be lower than a predetermined replacing time value of the at least one expandable, and a means for adding replacement request information to said status message if the amount of use is determined to be greater than the warning value.

24. An apparatus for generating a status message according to claim 23, further comprising a means for setting said amount of use to zero whenever the at least one expendable is replaced.

25. An apparatus for generating a status message according to claim 24, said means for setting said predetermined time period either to a fixed constant value, or to a predetermined number of papers set by a user.

26. An apparatus for generating a status message according to claim 23, said means for setting said predetermined time period either to a fixed constant value, or to a predetermined number of papers set by a user.

27. An apparatus for generating a status message in an image forming apparatus including at least one expendable, comprising:

a counter for counting a number of papers being printed after the at least one expendable has been replaced, and a nonvolatile memory for storing a counting value as an amount of use; and a means for causing the printing out of the status message including the amount of use at a predetermined time period;

said status message comprising a predetermined test pattern for testing a printing status of the image forming apparatus.

28. An apparatus for generating a status message according to claim 27, further comprising a means for setting said amount of use to zero whenever the at least one expendable is replaced.

29. An apparatus for generating a status message according to claim 28, said means for setting said predetermined time period either to a fixed constant value, or to a predetermined number of papers set by a user.

30. An apparatus for generating a status message according to claim 29, said status message comprising a predetermined replacing time value of the at least one expendable.

31. An apparatus for generating a status message according to claim 30, further comprising: a comparator for comparing said amount of use with a predetermined warning value which is set to be lower than said replacing time value, and a means for adding replacement request information to said status message if the amount of use is determined to be greater than the warning value.

32. An apparatus for generating a status message according to claim 27, said means for setting said predetermined time period either to a fixed constant value, or to a predetermined number of papers set by a user.

33. An apparatus for generating a status message according to claim 32, said status message comprising a predetermined replacing time value of the at least one expendable.

34. An apparatus for generating a status message according to claim 33, further comprising: a comparator for comparing said amount of use with a predetermined warning value which is set to be lower than said replacing time value, and a means for adding replacement request information to said status message if the amount of use is determined to be greater than the warning value.

* * * * *